US011643882B2

(12) United States Patent
Breaux et al.

(10) Patent No.: US 11,643,882 B2
(45) Date of Patent: May 9, 2023

(54) TUBULAR STRING WITH LOAD DISTRIBUTION SLEEVE FOR TUBULAR STRING CONNECTION

(71) Applicant: Halliburton Energy Services, Inc., Houston, TX (US)

(72) Inventors: Brian Breaux, Houston, TX (US); Pralay Das, Sugarland, TX (US); Anand Prakash, Tomball, TX (US); Michael Dewayne Finke, Cypress, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/443,134

(22) Filed: Jul. 21, 2021

(65) Prior Publication Data

US 2023/0028612 A1 Jan. 26, 2023

(51) Int. Cl.
*E21B 17/16* (2006.01)
*F16L 15/08* (2006.01)

(52) U.S. Cl.
CPC ..... *E21B 17/16* (2013.01)

(58) Field of Classification Search
CPC ..... E21B 17/16; F16L 15/08
See application file for complete search history.

(56) References Cited

U.S. PATENT DOCUMENTS 3,056,427 A * 10/1962 Higgins ..... E21B 17/006 16/108
4,139,023 A * 2/1979 Turley ..... B65D 59/06 138/96 T (Continued)

FOREIGN PATENT DOCUMENTS

| | | | | |
|---|---|---|---|---|
| CA | 250154 A1 * | 3/2005 | ..... | E21B 47/12 |
| EP | 1015802 B1 | 1/2008 | | |
| WO | 2010142038 A1 | 12/2010 | | |

OTHER PUBLICATIONS

International Search report and Written Opinion dated Apr. 20, 2022 for corresponding PCT Patent Application No. PCT/US2021/071034 filed on Jul. 28, 2021.

*Primary Examiner* — D. Andrews
*Assistant Examiner* — Ronald R Runyan
(74) *Attorney, Agent, or Firm* — K&L Gates LLP

(57) ABSTRACT

A tubular string includes a first tubular member with a pin end with pin threads and a pin external load shoulder. The tubular string also includes a second tubular member with a box end with a box external load shoulder and box threads, the pin threads being threadable into the box threads to form a connection, wherein the pin external load shoulder has an outer diameter (OD) that is different than an OD of the box external load shoulder. A load distribution sleeve is locatable between the first and second tubular members when threaded together and includes a first end facing the first tubular member and a second end facing the second tubular member, wherein the ODs of the load distribution sleeve first and second ends match the ODs of the pin and box external load shoulders respectively. The load distribution sleeve contacts the pin and box external load shoulders and distributes a make-up load between the pin and box external load shoulders when the connection is made up.

20 Claims, 5 Drawing Sheets

(56) References Cited

U.S. PATENT DOCUMENTS

| | | | | |
|---|---|---|---|---|
| 4,548,431 | A * | 10/1985 | Hall | E21B 17/042 285/390 |
| 2013/0105152 | A1 * | 5/2013 | Henderson | E21B 43/38 166/265 |
| 2017/0130843 | A1 | 5/2017 | Singh et al. | |
| 2019/0383105 | A1 | 12/2019 | Steinhoff et al. | |

* cited by examiner

TUBULAR STRING WITH LOAD DISTRIBUTION SLEEVE FOR TUBULAR STRING CONNECTION

BACKGROUND

This section is intended to provide relevant background information to facilitate a better understanding of the various aspects of the described embodiments. Accordingly, these statements are to be read in this light and not as admissions of prior art.

Hydrocarbons, such as oil and gas, are commonly obtained from subterranean formations that may be located onshore or offshore. In most cases, the formations are located thousands of feet below the surface, and a borehole must intersect the formations before the hydrocarbon can be recovered. Drilling tools and equipment used to reach the formations typically include multiple segments that are coupled using threads. These threaded connections may be subject to high torque and bending loads that the threaded connections must be able to handle without breaking or loosening. However, the size of the borehole and the drilling tools needed to pass through the borehole constrains the outer diameter of the connections between the segments and thus the amount of material available to add structural integrity to the connections. Thus, there is a challenge of minimizing the overall outer diameter (OD) while providing enough structural integrity to enable a connection to withstand large bending moments and torque.

BRIEF DESCRIPTION OF THE DRAWINGS

Embodiments of the tubular string with load distribution sleeve for tubular string connection are described with reference to the following figures. The same or sequentially similar numbers are used throughout the figures to reference like features and components. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

Figure 1:
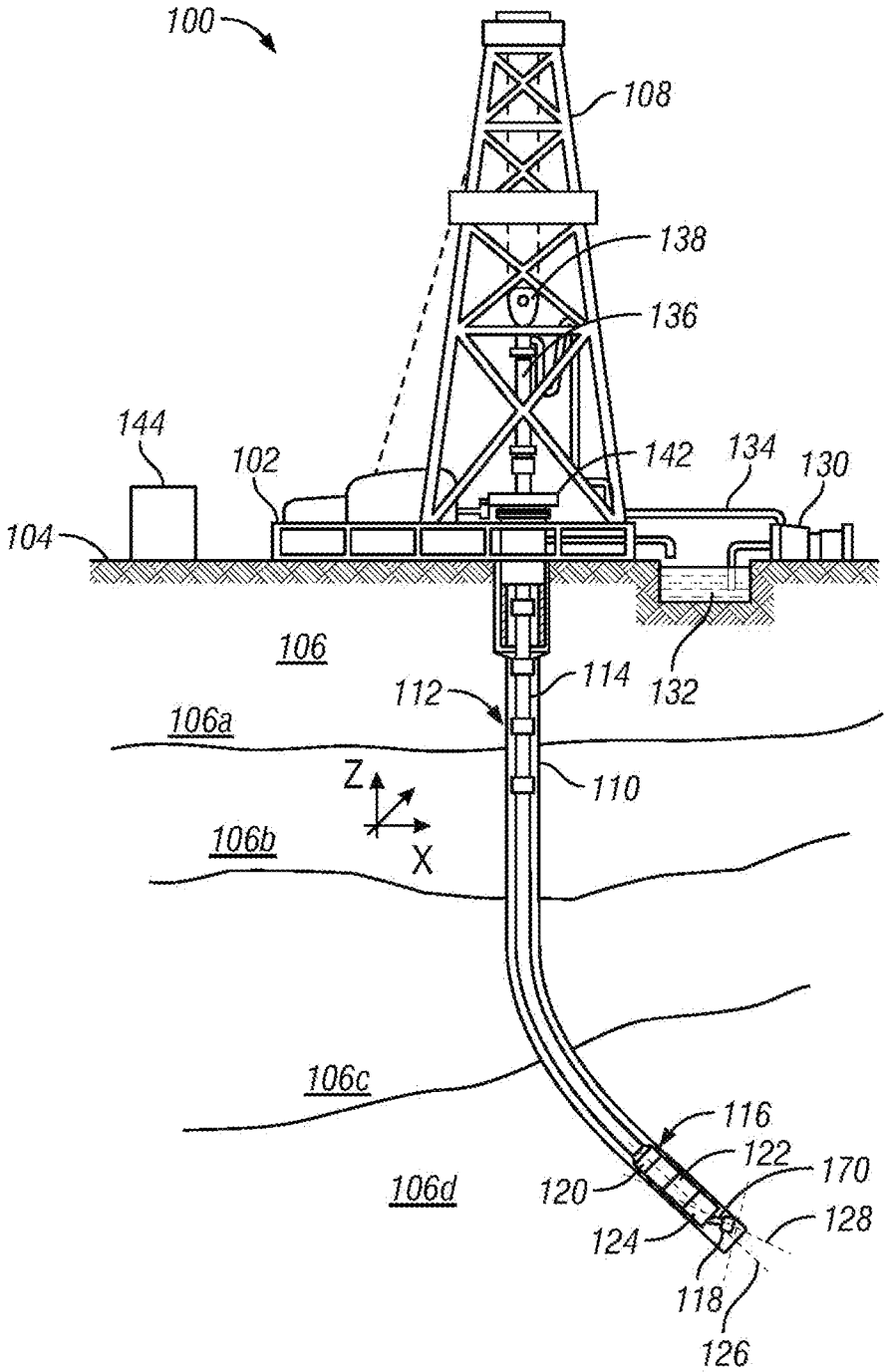
FIG. 1 is a diagram of an example drilling system, according to aspects of the present disclosure.

Illustrative embodiments of the present disclosure are described in detail herein. In the interest of clarity, not all features of an actual implementation may be described in this specification. It will of course be appreciated that in the development of any such actual embodiment, numerous implementation-specific decisions are made to achieve the specific implementation goals, which will vary from one implementation to another. Moreover, it will be appreciated that such a development effort might be complex and time-consuming, but would be a routine undertaking for those of ordinary skill in the art having the benefit of the present disclosure.

To facilitate a better understanding of the present disclosure, the following examples of certain embodiments are given. In no way should the following examples be read to limit, or define, the scope of the disclosure. Embodiments of the present disclosure may be applicable to horizontal, vertical, deviated, or otherwise nonlinear boreholes in any type of subterranean formation. Embodiments may be applicable to injection wells as well as production wells, including hydrocarbon wells. Embodiments may be applicable to both surface wells and subsea wells. Embodiments may be implemented using a tool that is made suitable for testing, retrieval and sampling along sections of the formation. Embodiments may be implemented with tools that, for example, may be conveyed through a flow passage in tubular string or using a wireline, slickline, coiled tubing, downhole robot or the like.

The terms "couple" or "couples" as used herein are intended to mean either an indirect or a direct connection. Thus, if a first device couples to a second device, that connection may be through a direct connection or through an indirect mechanical connection via other devices and connections.

The present disclosure is directed to a tubular string with at least two tubulars connected with a threaded connection with high bend and torque capacities. For the remainder of this disclosure, the threaded connection will be described with respect to downhole tools used in hydrocarbon recovery and drilling operations. Threaded connections incorporating aspects of the present disclosure are not limited to uses in hydrocarbon recovery and drilling operations, however. Rather, the threaded connections may be used in a variety of other applications that would be appreciated by one of ordinary skill in the art in view of this disclosure. The tubular members being connected have two different sized outer diameters. One reason for one tubular being smaller is to be able to fit equipment around the tubular but still fit within the borehole. To distribute the load created by making up the threaded connection, a load distribution sleeve is inserted between the tubular members. The outer diameters of each end of the load distribution sleeve match the size of the respective outer diameters of the external load shoulders of the tubular members of the connection. In this way, the load distribution sleeve provides enough contact area to distribute the make-up load across the contact surface areas of each of the tubular member external load shoulders and adequately withstand drilling conditions.

FIG. 1 is a diagram of an example steerable drilling system 100, according to aspects of the present disclosure. The drilling system 100 may comprise a drilling platform 102 positioned at the surface 104. In the embodiment shown, the surface 104 comprises the top of a formation 106 containing one or more rock strata or layers 106*a-d*. Although the surface 104 is shown as land in FIG. 1, the drilling platform 102 of some embodiments may be located at sea, in which case the surface 104 would be separated from the drilling platform 102 by a volume of water.

The drilling system 100 includes a rig 108 mounted on the drilling platform 102, positioned above a borehole 110 within the formation 106, and having a traveling block 138 for raising and lowering a drilling assembly 112 partially positioned within the borehole 110. The drilling assembly 112 comprises a drill string 114 with multiple drill pipe segments that are threadedly engaged. A kelly 136 supports the drill string 114 as it is lowered through a rotary table 142.

A drill bit 118 is coupled to the drill string 114 via a threaded connection, and driven by a downhole motor and/or rotation of the drill string 114 by the rotary table 142. As the bit 118 rotates, it extends the borehole 110. A pump 130 circulates drilling fluid through a feed pipe 134 to the kelly 136, downhole through the interior of the drill string 114, through orifices in the drill bit 118, back to the surface via the annulus around the drill string 114, and into a retention pit 132. The drilling fluid transports cuttings from the borehole 110 into the pit 132 and aids in maintaining integrity of the borehole 110.

The drilling assembly 112 may further comprise a bottom-hole assembly (BHA) 116. The BHA 116 is coupled to the drill string 114 through at least one threaded connection, as may the drill bit 118 to the BHA 116. The BHA 116 may include tools such as logging-while-drilling (LWD)/measurement while drilling (MWD) elements 122, a steering assembly 124, and a telemetry system 120. The LWD/MWD elements 122 may comprise downhole instruments, including sensors, that may continuously or intermittently monitor downhole drilling parameters and downhole conditions. The telemetry system 120 may provide communication with a surface control unit 144 over various channels, including wired and wireless communications channels as well as mud pulses through a drilling mud within the borehole 110. In certain embodiments, each of the LWD/MWD elements 122, the steering assembly 124, and the telemetry system 120 may be coupled together via threaded connections. Additionally, smaller elements within each of the LWD/MWD elements 122, the steering assembly 124, and the telemetry system 120 may be coupled together via threaded connections. The LWD/MWD elements 122 may include at least one resistivity logging tool, which may comprise two co-located coil antennas capable of transmitting and/or receiving one or more electromagnetic (EM) signals to and from the subterranean formations 106.

As the drill bit 118 extends the borehole 110 through the formations 106*a-c*, the resistivity logging tool may continuously or intermittently collect azimuthally-sensitive measurements relating to the resistivity of the formations 106*a-c*, i.e., how strongly the formations 106*a-c* oppose a flow of electric current. The resistivity logging tool and other sensors of the LWD/MWD 122 elements may be communicably coupled to the telemetry system 120 used to transfer measurements and signals from the BHA 116 to surface control unit 144 and/or to receive commands from the surface control unit 144. The telemetry system 120 may encompass any known means of downhole communication including, but not limited to, a mud pulse telemetry system, an acoustic telemetry system, a wired communications system, a wireless communications system, or any combination thereof. In certain embodiments, some or all of the measurements taken at the resistivity logging tool may also be stored within the resistivity logging tool or the telemetry system 120 for later retrieval at the surface upon retracting the drill string 114.

The steering assembly 124 may also comprise a bit sub 170 that is coupled to the drill bit 118 via a threaded connection and that transmits torque to the drill bit 118 for the purposes of extending the borehole 110 in the formation 106. The bit sub 170 also may be used by the steering assembly 124 to alter or maintain a drilling direction of the drilling system by altering or maintaining a longitudinal axis 128 of the drill bit 118. For example, the steering assembly 124 may impart lateral forces on the bit sub 170, which are transmitted then to the drill bit 118 to alter its longitudinal axis with respect to an axis 126 of the borehole 110. The bit sub 170 may also receive opposite lateral forces from the drill bit 118 when the drill bit 118 contacts the formation, which form a bending load on the bit sub 170. Thus, the bit sub 170 must withstand and transmit both torque and bending loads to the drill bit 118.

Figure 2:
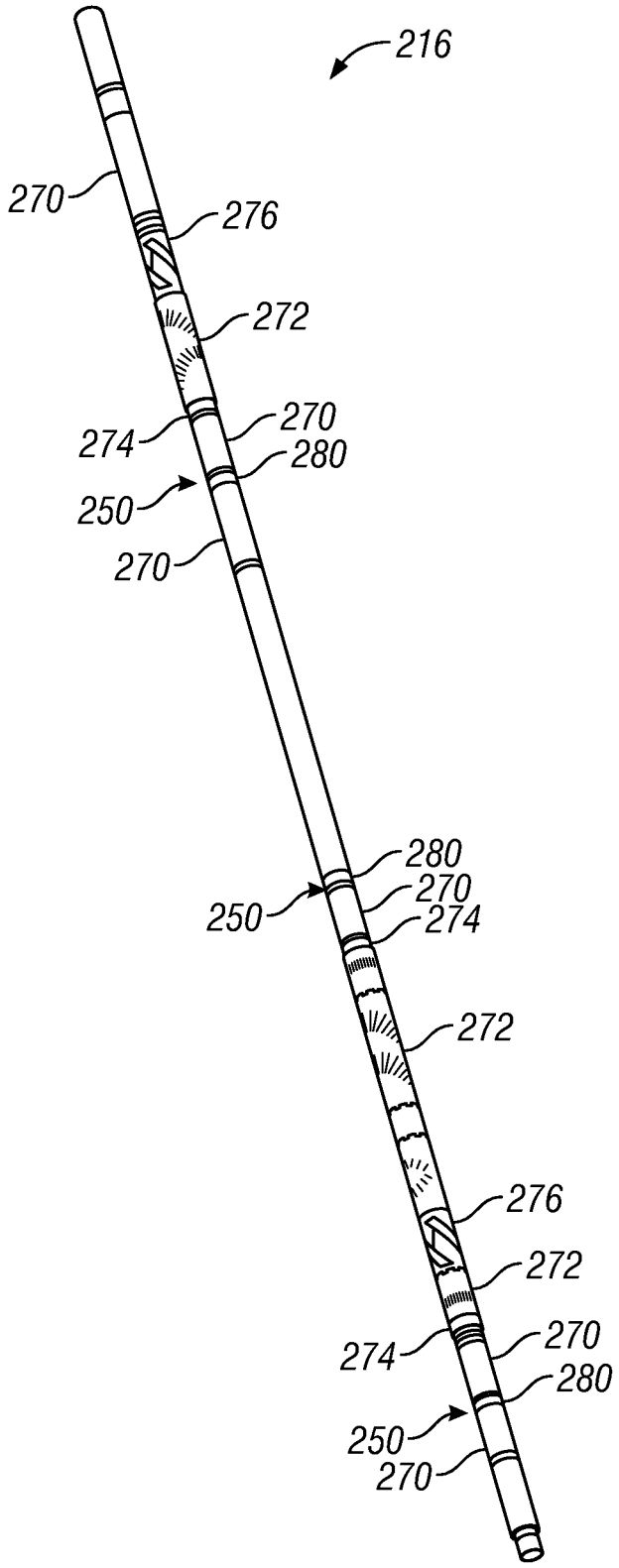
FIG. 2 is a diagram of a tubular string using connections for tubular members, according to aspects of the present disclosure.
Figure 3:
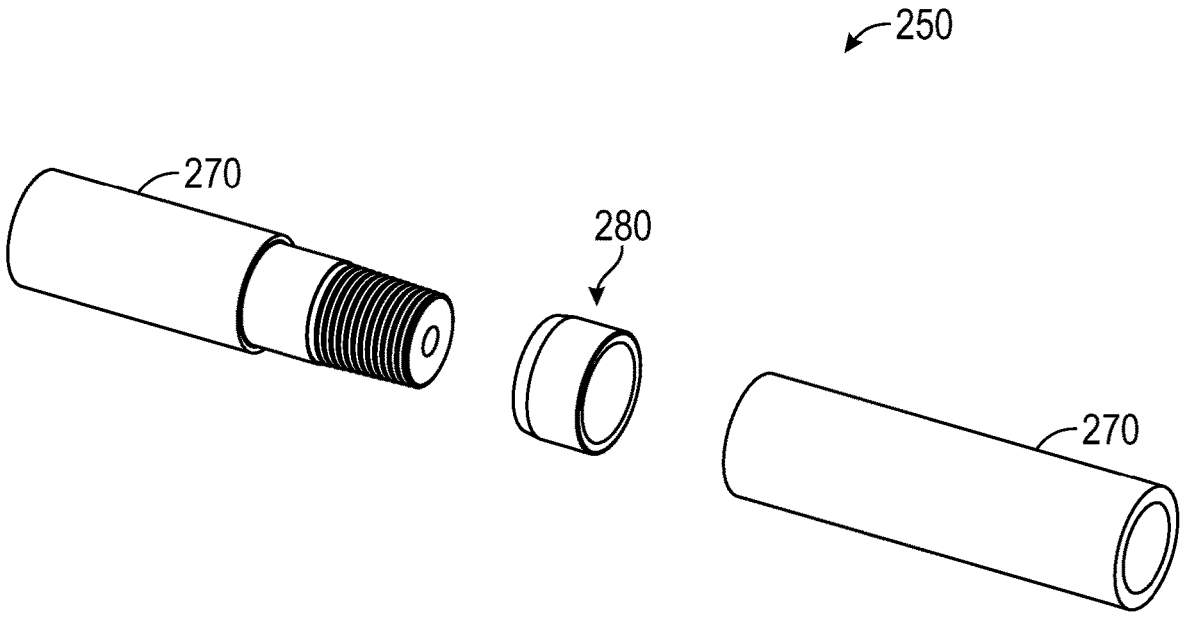
FIG. 3 is a diagram of a connection for a tubular string, according to aspects of the present disclosure.
Figure 4:
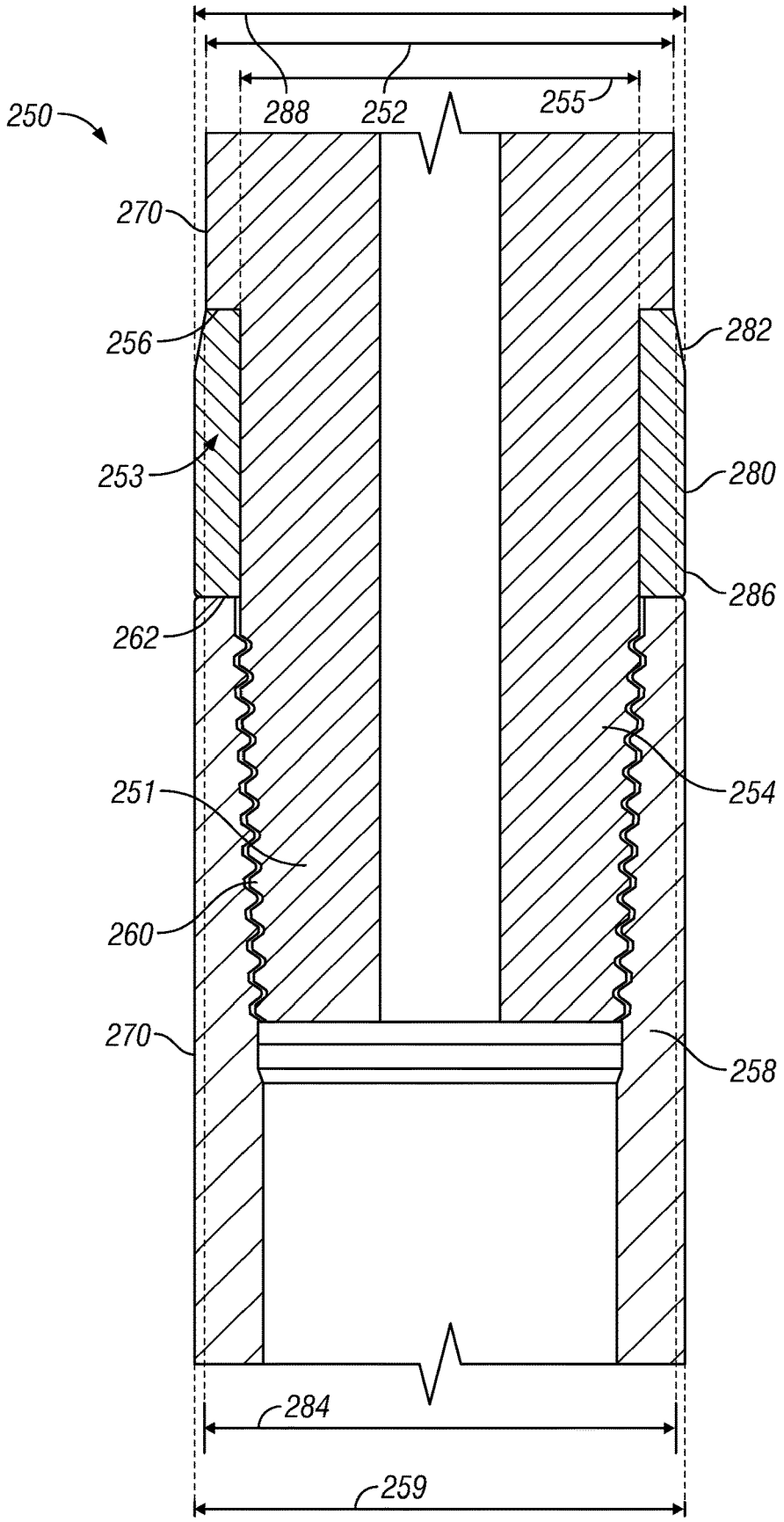
FIG. 4 is a diagram of a connection for a tubular string, according to aspects of the present disclosure.

FIGS. 2-4 are diagrams illustrating example threaded connections 250 that are part of a tubular string, such as the drill string 114 of FIG. 1, according to aspects of the present disclosure. The threaded connection 250 will be described below with respect to one of the tubular members being an antenna that is one of the LWD/MWD 122 elements, but the threaded connection 250 is equally applicable to other downhole applications where high torque and bending loads are present.

As shown in FIG. 2, the BHA 216 includes multiple tubular members 270 that make up the BHA 216, come of which are connected using the threaded connections 250. Any type of downhole threaded connection style can be used (HAL, API, etc.). Additionally, it should be appreciated that any suitable materials for downhole connections may be used. Some of the tubular members 270 include formation measurement equipment such as resistivity antennae for formation logging. Resistivity antennae are preferably located as close to the wall of the borehole as possible and thus on the outside of the tubular member 270 on which the antenna is located. To protect the antennae, each antenna is covered by an antenna sleeve 272 that slides over the outer diameter OD of the tubular members 270 with the antennae and held in place using securing rings 274. Wear bands 276 may also be slid over the OD of the tubulars for overall protection of the BHA tools.

Because the OD of the entire BHA 216 must be small enough to fit within a given size borehole, the OD of the tubular members 270 with the antennae must be small enough to accommodate the antenna sleeves 272 yet remain within the OD specifications of the BHA 216 for the borehole. Thus, the portion of the connection 250 on these tubular members 270 will be a smaller OD than the portion of the connection 250 on other tubular members 270 not needing to accommodate the antenna sleeves 272 and smaller than would otherwise be specified for the tubular members 270 with the larger OD. If the smaller OD portion of the connection 250 were to connect directly with the larger OD, there is a risk that there would not be enough contact area between the two portions to ensure that stress distribution on the contact surfaces would be adequate to withstand drilling conditions.

To distribute stresses across the connections 250 to withstand drilling conditions, the connections 250 further include load distributions sleeves 280. As shown more clearly in FIGS. 3 and 4, the threaded connection 250 comprises a pin end 251 with a threaded portion 254 on a cylindrical outer surface of a first tubular member 270. The threaded connection 250 also includes a box end 258 with a threaded portion 260 on a cylindrical inner surface of a second tubular member 270, the threaded portion 260 configured to threadedly engage with threaded portion 254. Each tubular member 270 also includes an inner diameter (ID) for the flow of drilling fluid to a drill bit below the BHA 216.

The first tubular member pin end 251 comprises a cylindrical tubular element having a first pin end OD 252. The first tubular member pin end 251 also includes a neck section 253 with a neck OD 255 smaller than the first pin end OD 252, thus creating a pin end external load shoulder 256 with a pin external load shoulder OD the same as the first pin end OD 252. The length of the neck section 253 provides space for the load distribution sleeve 280 to slide over the pin end 251 and engage the pin end external load shoulder 256. The length of the neck section 253 and the neck OD 255 also affect the stiffness of the pin end 251 and thus the first tubular member 270 and the connection 250. The length of the neck section 253 may also be selected to provide allowance for re-machining the threads of threaded portion 254 of the pin end 251 to repair damage that may occur through operation.

The second tubular member 270 also may comprise a cylindrical tubular component, characterized by a box end OD 259 that is larger than the first pin end OD 253. The second tubular member 270 also includes a box external load shoulder 262 formed by a face between the box end OD 259 and the second tubular member 270 ID. Thus, the box external load shoulder 262 has a box external load shoulder OD the same as the box OD 259 and different from the pin external load shoulder OD. Although the box external load shoulder OD is shown and being larger than the pin external load shoulder OD, it should be appreciated that the box external load shoulder OD may instead be smaller than the pin external load shoulder OD.

The connection 250 further includes a load distribution sleeve 280 located between the first and second tubular members 270 when threaded together. The load distribution sleeve 280 includes a first end 282 facing the first tubular member 270 and having an OD 284 matching the OD of the pin external load shoulder 256. The load distribution sleeve 280 also includes a second end 286 facing the second tubular member 270 and having an OD 288 matching the OD of the box external load shoulder 262.

The load distribution sleeve 280 is sized and positioned between the first and second tubular members 270 to contact the pin external load shoulder 256 on one side and the box external load shoulder 262 on the other side. The load distribution sleeve 280 thus receives axial make-up loads from the first and second tubular members 270 when the threads 204 and 210 are fully engaged, as is shown in FIG. 4. The magnitude of the make-up loads distributed by the load distribution sleeve 280 depends, in part, on the contact surface area between the ends of the load distribution sleeve 280 and the respective pin and box external load shoulders 256, 262, and positively correlates with the torque limit of the threaded connection 250. With the load distribution sleeve 280 having different ODs at each end, the contact surface area of the box end can be increased, as can be the torque limit of the threaded connection 250. In addition to accommodating the load requirements for the connection 250, the tubular members 270 and the load distribution sleeve 280 may also be designed to control overall joint stiffness control by controlling the ratio of the box end 258 stiffness to pin end 251 stiffness.

The connection 250 may comprise a "loaded" or "made up" connection between the threaded portion 254 with the threaded portion 260, and the load distribution sleeve 280 contacting the respective pin and box external load shoulders 256, 262. The combined frictional, axial, and radial forces acting on the first and second tubular members 270 and their corresponding parts may provide the interference fit and loaded connection that may improve the bending and torque load limit of the threaded connection 250.

While any suitable materials may be used for the tubular members 270 and the load distribution sleeve 280, there may be applications for the where the first tubular member 270 with a smaller pin end OD 253 may require enlargement of the ID for clearance of internal components while not being able to enlarge the pin end OD 253. With less material, the strength of the connection 250 is weakened by the pin end 251. If desired or needed, the yield strength of the pin end 251 material may be increased relative to the box end 258 material, thus increasing the torque capacity and, depending on material fatigue properties of the pin end 251, the fatigue strength for the pin end 251 and for the overall connection 250. The load distribution sleeve 280 with a higher yield strength allows the first tubular member 270 with a smaller OD with a higher yield strength to be balanced in strength with the lower strength tubular member 270 with the larger OD. Additionally, load distribution sleeve 280 may be a material selected to control galling. If the pin end 251 and the box end 258 are made from materials that tend to gall when moving against each other with a high contact force, damage can occur at the faces of the pin end external load shoulder 256 and the box external load shoulder 262. To mitigate this galling, the load distribution sleeve 280 may be made of a self-lubricating material, for example a copper-beryllium alloy.

Figure 5:
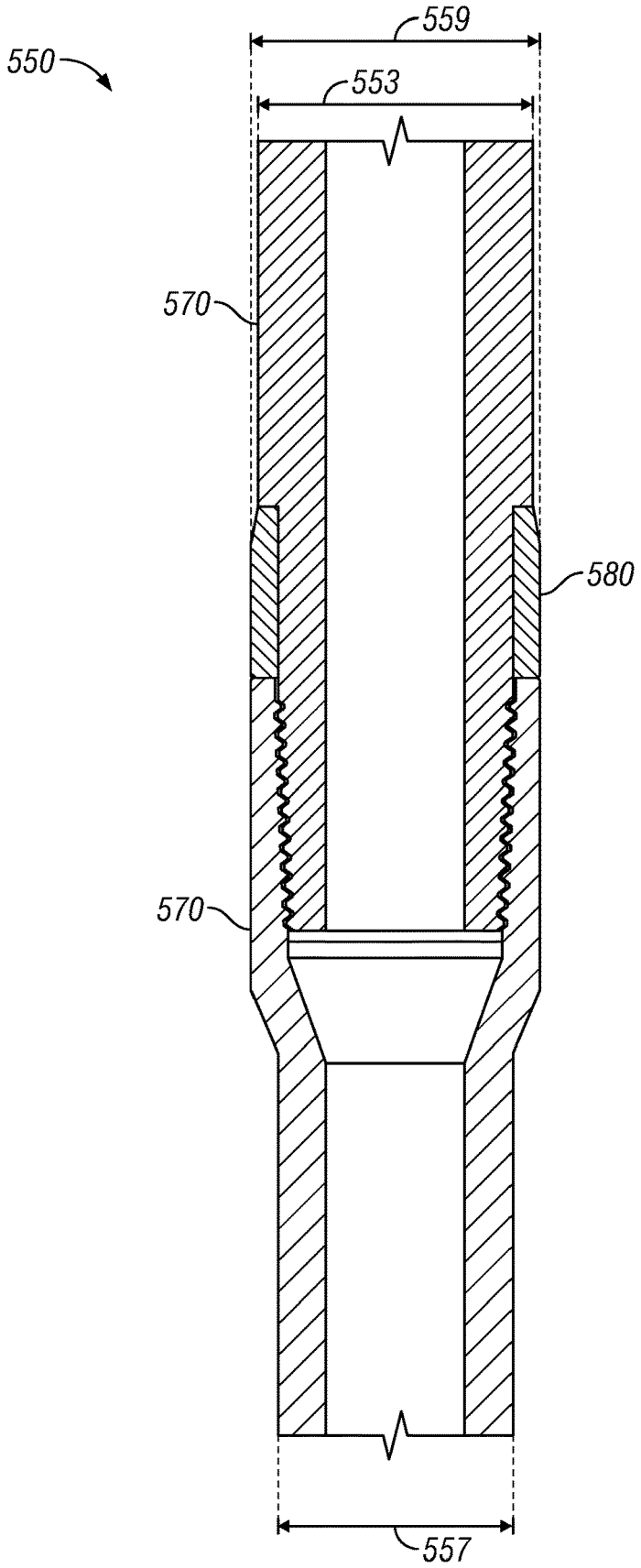
FIG. 5 is a diagram of an alternative embodiment of a connection for a tubular string, according to aspects of the present disclosure.

FIG. 5 is a diagram illustrating an alternative example threaded connection 550. The threaded connection 550 is similarly between two tubular members 570 with a load distribution sleeve 580 that distributes make-up load when the connection 550 is made-up. Similarly, the pin end OD 553 is smaller than the box end OD 559. However, the second tubular member 270 also includes a section with a decreased OD 557 that is smaller than the box end OD 559 as well as smaller than the first tubular member OD 553.

Examples of the above embodiments include the following numbered examples:

Example 1 is a tubular string comprising a first tubular member comprising a pin end comprising pin threads and a pin external load shoulder. The tubular string also comprises a second tubular member comprising a box end comprising a box external load shoulder and box threads, the pin threads threadable into the box threads to form a connection, wherein the pin external load shoulder has an outer diameter (OD) that is different than an OD of the box external load shoulder. The tubular string also comprises a load distribution sleeve locatable between the first and second tubular members when threaded together and comprising a first end facing the first tubular member and a second end facing the second tubular member, wherein ODs of the load distribution sleeve first and second ends match the ODs of the pin and box external load shoulders respectively. Further, the load distribution sleeve contacts the pin and box external load shoulders and distributes a make-up load between the pin and box external load shoulders when the connection is made up.

Example 2. The tubular string of Example 1, wherein the OD of the pin external load shoulder is smaller than the OD of the box external load shoulder.

Example 3. The tubular string of Example 1, wherein the OD of the pin external load shoulder is larger than the OD of the box external load shoulder.

Example 4. The tubular string of Example 1, further comprising a protective sleeve slidable over the first tubular member.

Example 5. The tubular string of Example 4, wherein the protective sleeve has a sleeve OD matching the OD of the box external load shoulder.

Example 6. The tubular string of Example 1, wherein the first tubular member comprises a resistivity antennae and the tubular string further comprises an antennae sleeve slidable over the first tubular member.

Example 7. The tubular string of Example 1, wherein the tubular string comprises a drill string.

Example 8. The tubular string of Example 7, wherein the tubular string comprises a bottom-hole assembly.

Example 9. A method of forming a tubular string, comprising engaging a load distribution sleeve with a first tubular member comprising a pin end comprising pin threads and a pin external load shoulder such that a first end of the load distribution sleeve engages the pin external load shoulder. The method also comprises threading the pin threads into a box end of a second tubular member, the box end comprising a box external load shoulder and box threads, to engage a second end of the load distribution sleeve with the box external load shoulder and make up a connection and distribute a make up load between the pin and box external load shoulders with the load distribution sleeve. Further, the outer diameters (ODs) of the pin and box external load shoulders are different and ODs of the load distribution sleeve first and second ends match the ODs of the pin and box external load shoulders respectively.

Example 10. The method of Example 9, wherein the OD of the pin external load shoulder is smaller than the OD of the box external load shoulder.

Example 11. The method of Example 9, wherein the OD of the pin external load shoulder is larger than the OD of the box external load shoulder.

Example 12. The method of Example 9, further comprising sliding a protective sleeve over the first tubular member before the connection is made up.

Example 13. The method of Example 12, wherein the protective sleeve has a sleeve OD matching the OD of the box external load shoulder.

Example 14. The method of Example 9, wherein the tubular string comprises a drill string.

Example 15. The method of Example 14, further comprising at least one of drilling a borehole through a formation using the drill string or measuring properties of the formation using a sensor on the drill string.

Example 16. A threadable connection comprising a first tubular member comprising a pin end comprising pin threads and a pin external load shoulder. The connection also comprises a second tubular member comprising a box end comprising a box external load shoulder and box threads, the pin threads threadable into the box threads to form a connection, wherein the pin external load shoulder has an outer diameter (OD) that is different than an OD of the box external load shoulder. The connection also comprises a load distribution sleeve locatable between the first and second tubular members when threaded together and comprising a first end having an OD matching the OD of the box external load shoulder and a second end having an OD matching the OD of the pin external load shoulder. Further, the load distribution sleeve distributes a make up load between the pin and box external load shoulders when the connection is made up.

Example 17. The threadable connection of Example 16, wherein the OD of the pin external load shoulder is smaller than the OD of the box external load shoulder.

Example 18. The threadable connection of Example 16, wherein the OD of the pin external load shoulder is larger than the OD of the box external load shoulder.

Example 19. The threadable connection of Example 16, wherein the first and second tubulars are part of a drill string.

Example 20. The threadable connection of Example 16, wherein at least one of the first and second tubulars is part of a bottom-hole assembly.

Unless otherwise indicated, all numbers expressing quantities of ingredients, properties such as molecular weight, reaction conditions, and so forth used in the present specification and associated claims are to be understood as being modified in all instances by the term "about."

The embodiments and examples disclosed are illustrative only and should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment. Also, the terms in the claims have their plain, ordinary meaning unless otherwise explicitly and clearly defined by the patentee. The indefinite articles "a" or "an," as used in the claims, are defined herein to mean one or more than one of the component that it introduces.

What is claimed is:

1. A tubular string comprising:

a first tubular member having a first tubular yield strength and comprising a first tubular outer diameter (OD), a pin end comprising pin threads, and a neck section with a neck OD smaller than the first tubular OD so as to create a pin external load shoulder with a pin external load shoulder OD;

a second tubular member having a second tubular yield strength that is different than the first tubular yield strength and comprising a second tubular OD that is different than the first tubular OD and a box end comprising a box external load shoulder and box threads, the pin threads being threadable into the box threads to form a connection, wherein the pin external load shoulder OD is different than an OD of the box external load shoulder;

a load distribution sleeve locatable between the first and second tubular members when threaded together and centered by engagement with the neck OD, the load distribution sleeve comprising a first end facing the first tubular member and a second end facing the second tubular member, wherein ODs of the load distribution sleeve first and second ends match the ODs of the pin and box external load shoulders respectively; and wherein the load distribution sleeve contacts the pin and box external load shoulders and distributes a make-up load between the pin and box external load shoulders when the connection is made up.

2. The tubular string of claim 1, wherein the OD of the pin external load shoulder is smaller than the OD of the box external load shoulder.

3. The tubular string of claim 1, wherein the OD of the pin external load shoulder is larger than the OD of the box external load shoulder.

4. The tubular string of claim 1, further comprising an antenna sleeve slidable over the first tubular member.

5. The tubular string of claim 4, wherein the antenna sleeve has a sleeve OD matching the OD of the box external load shoulder.

6. The tubular string of claim 1, wherein the first tubular member comprises a resistivity antennae and the tubular string further comprises an antennae sleeve slidable over the first tubular member.

7. The tubular string of claim 1, wherein the tubular string comprises a drill string.

8. The tubular string of claim 7, wherein the tubular string comprises a bottom-hole assembly.

9. A method of forming a tubular string, comprising:

engaging a load distribution sleeve with a first tubular member having a first tubular yield strength and comprising a first tubular outer diameter (OD), a pin end comprising pin threads, and a neck section with a neck OD smaller than the first tubular OD so as to create a pin external load shoulder with a pin external load shoulder OD such that a first end of the load distribution sleeve engages the pin external load shoulder and the load distribution sleeve is centered by engagement with the neck OD;

threading the pin threads into a box end of a second tubular member having a second tubular yield strength that is different from the first tubular yield strength and comprising a second tubular OD that is different than the first tubular OD, the box end comprising a box external load shoulder and box threads, to engage a second end of the load distribution sleeve with the box external load shoulder and make up a connection and distribute a make up load between the pin and box external load shoulders with the load distribution sleeve; and wherein ODs of the pin and box external load shoulders are different and ODs of the load distribution sleeve first and second ends match the ODs of the pin and box external load shoulders respectively.

10. The method of claim 9, wherein the OD of the pin external load shoulder is smaller than the OD of the box external load shoulder.

11. The method of claim 9, wherein the OD of the pin external load shoulder is larger than the OD of the box external load shoulder.

12. The method of claim 9, further comprising sliding an antenna sleeve over the first tubular member before the connection is made up.

13. The method of claim 12, wherein the antenna sleeve has a sleeve OD matching the OD of the box external load shoulder.

14. The method of claim 9, wherein the tubular string comprises a drill string.

15. The method of claim 14, further comprising at least one of drilling a borehole through a formation using the drill string or measuring properties of the formation using a sensor on the drill string.

16. A threadable connection comprising:

a first tubular member having a first tubular yield strength and comprising a first tubular outer diameter (OD), a pin end comprising pin threads, and a neck section with a neck OD smaller than the first tubular OD so as to create a pin external load shoulder with a pin external load shoulder OD;

a second tubular member having a second tubular yield strength that is different than the first tubular yield strength and comprising a second tubular OD that is different than the first tubular OD and a box end comprising a box external load shoulder and box threads, the pin threads threadable into the box threads to form a connection, wherein the pin external load shoulder OD is different than an OD of the box external load shoulder;

a load distribution sleeve locatable between the first and second tubular members when threaded together and centered by engagement with the neck OD, the load distribution sleeve comprising a first end having an OD matching the OD of the box external load shoulder and a second end having an OD matching the OD of the pin external load shoulder; and wherein the load distribution sleeve distributes a make up load between the pin and box external load shoulders when the connection is made up.

17. The threadable connection of claim 16, wherein the OD of the pin external load shoulder is smaller than the OD of the box external load shoulder.

18. The threadable connection of claim 16, wherein the OD of the pin external load shoulder is larger than the OD of the box external load shoulder.

19. The threadable connection of claim 16, wherein the first and second tubulars are part of a drill string.

20. The threadable connection of claim 16, wherein at least one of the first and second tubulars is part of a bottom-hole assembly.

* * * * *